United States Patent [19]

Fitzgerald

[11] 4,011,965

[45] Mar. 15, 1977

[54] ENVELOPE-VENDING MACHINE

[76] Inventor: Robert E. Fitzgerald, P.O. Box 100, Barrington, Ill. 60010

[22] Filed: Jan. 21, 1976

[21] Appl. No.: 650,888

[52] U.S. Cl. ..... 221/40; 221/240

[51] Int. Cl.[2] ..... B65H 3/36

[58] Field of Search ..... 221/240, 276, 36, 41, 221/40

[56] References Cited

UNITED STATES PATENTS

| | | | |
|---|---|---|---|
| 1,362,817 | 12/1920 | Parsons | 221/41 X |
| 2,258,358 | 10/1941 | Harvey | 221/36 X |
| 2,848,137 | 8/1958 | Cramer | 221/36 |
| 2,862,642 | 12/1958 | Shipman | 221/36 |
| 3,214,058 | 10/1965 | Sergio | 221/240 X |

*Primary Examiner*—Stanley H. Tollberg
*Attorney, Agent, or Firm*—Edward C. Threedy

[57] ABSTRACT

A coin-controlled manually operated envelope-vending machine having a vertical supply compartment whereby the lowermost envelope of the supply is available to a yieldable vending member having a horizontal reciprocal movement for engagement with a portion of the lowermost envelope so as to displace the same exteriorly of the machine to facilitate the complete removal of the envelope therefrom.

2 Claims, 6 Drawing Figures

ENVELOPE-VENDING MACHINE

SUMMARY OF THE INVENTION

The coin-controlled manually operated vending machine of this invention provides a vending mechanism whereby the sealing flap of the envelope is presented to a vending member having reciprocal movement within the apparatus, whereby such sealing flap is exposed through a vending slot and made accessible exteriorly of the apparatus so that the same may be grasped and pulled so as to withdraw the entire envelope from the machine.

By utilizing the sealing flap of the envelope, the vending machine may be arranged whereby one or more envelopes may be simultaneously vended through a single operation. To accomplish this, all that one need do is to nest a plurality of envelopes so that the sealing flaps thereof overlap one another. By this arrangement, upon reciprocal movement of the vending mechanism, more than one envelope may be readily vended through a single slot and by a single operation.

Within the mechanism there is a vertical supply compartment in which the envelopes to be vended are stored. These envelopes are adapted to rest upon positioning rods extending transversely with respect to the reciprocal movement of a vending plate. The vending plate will have engagement with one of these rods and be yieldably cammed through a vertical plane into a vending position with respect to the sealing flap of an envelope for the purpose of displacing the same through a delivery slot provided in the front wall of the apparatus.

GENERAL DESCRIPTION

The invention will be best understood by reference to the accompanying drawings which show the preferred form of construction by which the stated objects of the invention are achieved, and in which.

Figure 1:
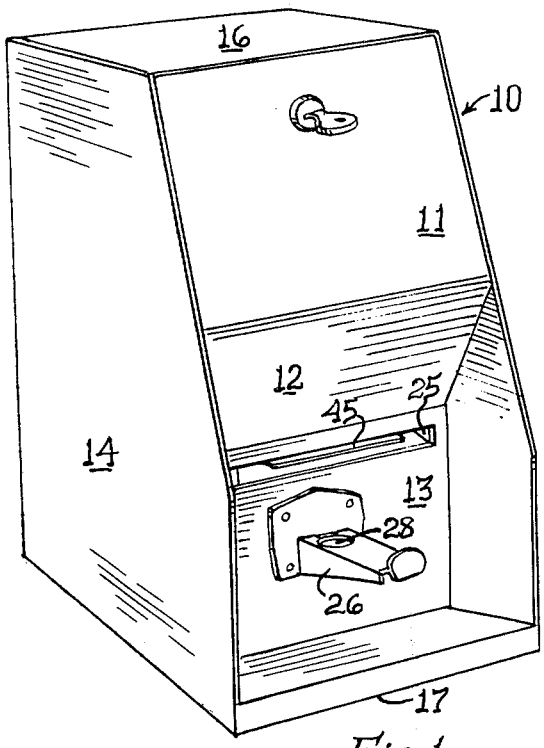
FIG. 1 is a perspective view of the envelope-vending machine.
Figure 2:
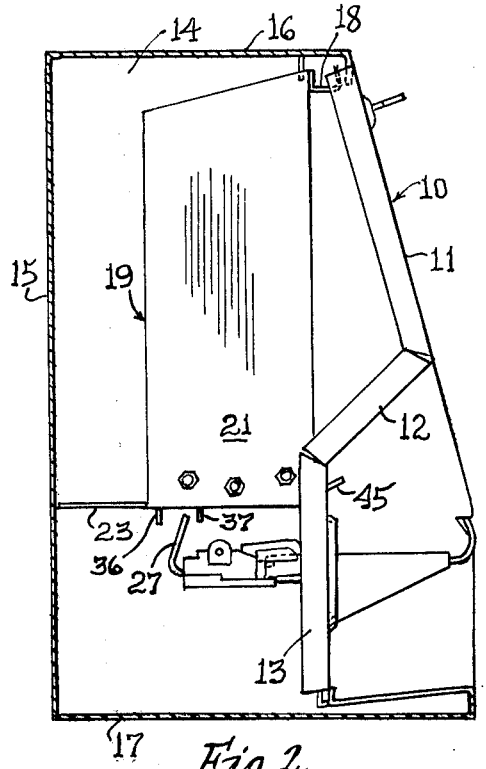
FIG. 2 is a sectional side view of the envelope-vending machine.

The envelope vending machine of this invention, as shown in FIG. 1, comprises a cabinet 10 having a front wall 11, the medial portion 12 of which is tapered inwardly to where it terminates into a depending recessed panel 13. The cabinet 10 includes side walls 14, a rear wall 15, as well as a top and bottom wall 16 and 17, respectively.

The front wall 11 by a bracket 18 supports in a substantially vertical plane a supply compartment 19. This compartment 19 consists of side walls 20 and 21, as well as a front wall 22, together with a bottom wall 23.

Figure 5:
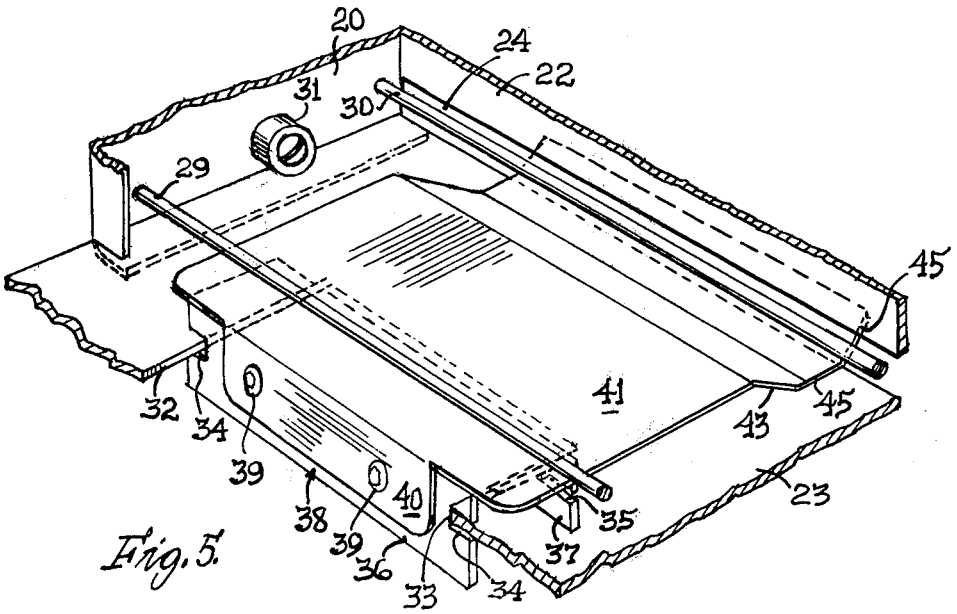
FIG. 5 is a fragmentary detailed sectional view of the vending plate.

As shown in FIG. 5, the front wall 22 of the vending compartment 19 provides an open slot 24 which registers with a dispensing slot 25 formed in the recessed panel 13 of the cabinet 10, as shown. Mounted on the panel 13 of the cabinet 10 beneath the dispensing slot 25 is a coin slide 26 of the type well-known in the art and which is known as a "full-stroke" coin slide, in that, while it has a reciprocal movement, the direction cannot be reversed until movement in either direction is through a complete path of travel.

While the coin slide 26 forms no part of this invention, it does provide a vertically extending actuating finger 27 mounted on the interior end of the coin slide 26 which, when properly conditioned, will actuate the vending cycle of the apparatus. For the coin slide 26 to be properly conditioned, it requires that a proper denomination of coin be placed in the coin receptacle 28 provided by the coin slide 26.

Extending between the side walls 20 and 21 of the supply compartment 19 are a pair of horizontally extending, as well as horizontally spaced, support rods 29 and 30. Disposed between each of the rods 29 and 30 on the interior surface of each of the side walls 20 and 21 is a roller 31 (only one being shown in FIG. 5), the purpose and function of which will hereinafter be made more apparent.

As shown in FIG. 5, the bottom wall 23 of the supply compartment 19 is from the rearward edge thereof notched so as to provide guiding edges 32 and 33. These guiding edges 32 and 33 are adapted to be disposed into corresponding horizontally aligned notches 34 and 35 formed in the parallelly extending arms 36 and 37 of a U-shaped carrier 38. Fastened to the carrier 38 as at 39 is a depending lip 40 of a vending plate 41. The vending plate 41 provides a substantially rectangular, flat surface 42 which has a portion 43 angularly bent out of the normal plane of the face 42 in a depending direction, which in turn continues into a horizontal run 44 that terminates into an angularly upstanding flange 45. The flange 45 constitutes a pusher which, in its normal condition, extends out of the slots 24 and 25 heretofore identified.

Figure 3:
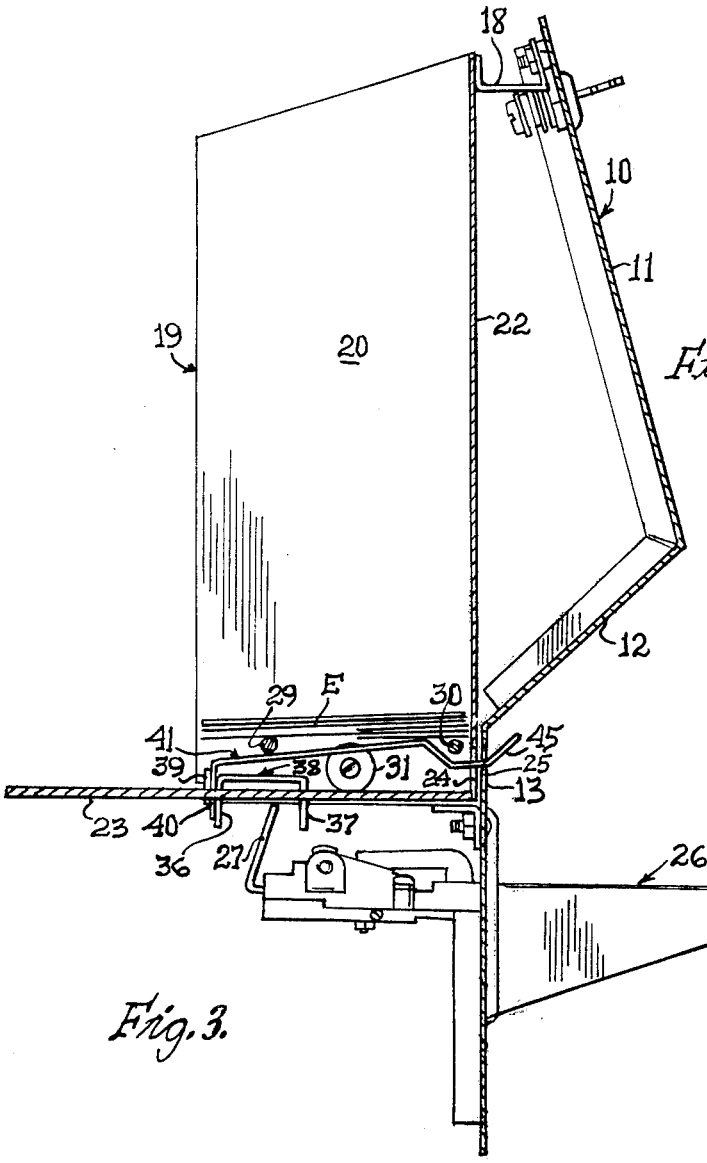
FIG. 3 is a sectional side view of the vending mechanism as employed in the apparatus.
Figure 4:
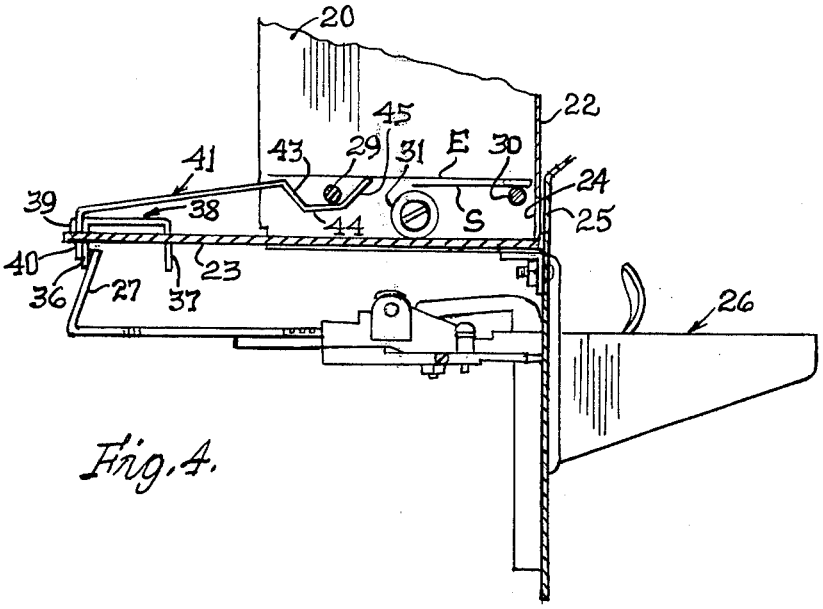
FIG. 4 is a fragmentary sectional view of the vending mechanism in one position.

As viewed in FIG. 3, the vending mechanism is in its normal inoperative condition. As there shown, the vending plate 41 is disposed beneath the support rods 29 and 30. Contained within the supply compartment 19 is a stack of envelopes, one of such envelopes E being figuratively shown in FIGS. 3 and 4. These envelopes have their sealing flaps S facing downward and adjacent the front wall of the supply compartment 19.

When a proper coin is placed in the coin slide 26 and the slide is pushed inwardly of the apparatus, the finger 27 thereof will engage the depending arm 36 of the carrier 38 and will cause the same to be moved rearwardly over the bottom wall 23 of the compartment 19 through the full stroke of the coin slide 26. At such time the mechanism will be in the condition shown in FIG. 4. The vending plate 41 will have been moved rearwardly such that the rearmost supporting rod 29 will be now disposed between the angular portions 43 and 45 of the vending plate 41. By the disposition of the rod 29 into the recessed area of the vending plate 41, the same through its inherent biased condition will have a substantially vertical movement with respect to the carrier 38, such that the pusher 45 will engage the bottommost envelope E and slightly raise the same off the supporting rod 29.

Figure 6:
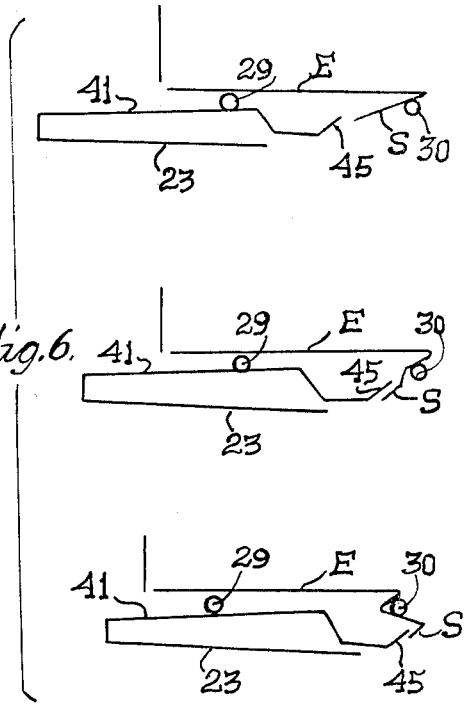
FIG. 6 is a series of diagrammatic views of the vending operation of the apparatus.

As the coin slide 26 is moved in an opposite direction, the finger 27 will engage the opposite arm 37 of the carrier 38 and, together with the vending plate 41, move the same in a forward direction whereby the rod 29 will engage the depending portion 43 of the vending plate 41 and cam the same in a downward direction against its normal yieldable bias. However, by the time the rod 29 is performing its camming function, the pusher 45 will already have engaged and become disposed beneath the sealing flap S of the envelope E. This is diagrammatically shown in FIG. 6. As the coin slide 26 continues its reciprocal movement, the pusher will force the sealing flap S of the flap E about the second supporting rod 30 and out of the slots 24 and 25. In this position, the sealing flap S of the envelope E can be grasped and the envelope can be completely removed with respect to the cabinet 10. As the envelope is pulled through the supply compartment 19, the leading edge portion thereof will pass off the rod 30 and onto the opposite disposed rollers 31, which will aid in the movement of dispensing the envelope through the slots 24 and 25.

The above operation will be accomplished notwithstanding that a plurality of envelopes are nested so that their sealing flaps overlap each other. Thus, for example, three envelopes may be nested with their sealing flaps overlapping each other, the innermost one of which will be engaged by the pusher 45 of the vending plate 41 as the same is reciprocally moved within the cabinet 10 of the vending machine.

While I have illustrated and described the preferred form of construction for carrying my invention into effect, this is capable of variation and modification without departing from the spirit of the invention. I, therefore, do not wish to be limited to the precise details of construction set forth, but desire to avail myself of such variations and modifications as come within the scope of the appended claims.

Having thus described my invention, what I claim as new and desire to protect by Letters Patent is:

1. In an envelope-vending machine having a coin-controlled manually operated activating mechanism that effects vending of an envelope through a dispensing slot provided by the machine, wherein the improvement provides a. a vertical envelope supply compartment having a bottom wall juxtapositioned with respect to the dispensing slot of the machine, b. a pair of envelope-supporting rods extending in spaced parallel relation above said bottom wall of said compartment and the dispensing slot of the machine, c. a dispensing member reciprocally movable through said compartment over said bottom wall through a plane normal to the dispensing slot of the machine, d. a spring-biased envelope-engaging plate connected to and movable linearly through said compartment with said dispensing member and into contact with said one of said rods and yieldably movable thereby through a substantially vertical component into contact with and beneath the sealing flap of the lowermost envelope of the supply of envelopes within said compartment, with said envelope-engaging plate adapted to push the sealing flap of the envelope out of the dispensing slot of the machine upon complete reciprocal movement of said dispensing member over said bottom wall of said envelope supply compartment.

2. An envelope-vending machine as defined by claim 1 including means carried by said bottom wall of said compartment for supporting and guiding said dispensing member, comprising a substantially U-shaped carrier, the parallel arms of which are notched to receive corresponding notched edges of said bottom wall whereby said carrier is guided through a substantially horizontal plane as it is moved reciprocally beneath said envelope supply compartment.

* * * * *